United States Patent [19]

Keddy

[11] Patent Number: 4,634,339

[45] Date of Patent: Jan. 6, 1987

[54] AIR MOVER

[76] Inventor: Roy C. Keddy, 705 Main St., Wakefield, Mass. 01880

[21] Appl. No.: 587,153

[22] Filed: Mar. 7, 1984

[51] Int. Cl.[4] ..... F24F 7/007

[52] U.S. Cl. ..... 415/70; 98/33.1; 98/94.1

[58] Field of Search ..... 98/33 R, 94; 415/70; 416/111

[56] References Cited

U.S. PATENT DOCUMENTS

| | | | |
|---|---|---|---|
| 526,533 | 9/1894 | Knapp | 416/111 |
| 574,619 | 1/1897 | Miller . | |
| 1,039,025 | 9/1912 | Carroll | 98/33 R X |
| 1,279,698 | 9/1918 | Horne | 416/111 |
| 2,036,727 | 4/1936 | Stow | 416/111 |
| 2,152,614 | 3/1939 | Younger | 98/33 |
| 2,206,858 | 7/1940 | McKee | 257/1 |
| 2,212,050 | 8/1940 | Samuelson et al. | 98/33 R |
| 3,915,586 | 10/1975 | Gassie | 416/111 |
| 4,102,596 | 7/1978 | Itayama | 415/101 |
| 4,102,597 | 7/1978 | Itayama | 415/101 |

*Primary Examiner*—Harold Joyce

*Attorney, Agent, or Firm*—Morse, Altman & Dacey

[57] ABSTRACT

A device for moving air quietly and in volume comprising a frame, a pair of disks or rotor in another form eccentrically and rotatably supported in spaced apart relationship in the frame and a plurality of paddle members mounted, with their planes at approximate right angles to the flow of air, to and between the pair of rotors. Preferably one of the pair of rotors is driven, which in turn rotates the other rotor via the connection of the paddle members or both rotors are driven separately. When placed in a vertical attitude, in order to mount paddles to be at approximate right angles to the flow of air, one rotor supports the top of the paddles at one end of them, and the other rotor, located suitably lower, supports the bottom of the paddles at the other end of them. Thus the paddles are all continually vertical as they rotate to push air in volume in two directions through the top and bottom parts.

9 Claims, 3 Drawing Figures

AIR MOVER

BACKGROUND OF THE INVENTION

1. Field of the Invention

The present invention relates generally to air movers and, more particularly, to a device for moving air quietly in volume.

2. The Prior Art

Present day air movers essentially are of two kinds: fans and blowers. Fans employ propeller blades that cut and whirl the air, while blowers project the same by centrifugal force. Fans and blowers exhibit a common trait, which is undesirable to some, if not most, people: they are noisy. Most of their noise pollution is a natural consequence of the way they propel or project the air, thus being unavoidable.

This problem of noise pollution is and remains, therefore, a fundamental drawback to the employment and use of conventional air movers, such as fans and blowers, where quietness is desired.

SUMMARY OF THE INVENTION

It is a principal object of the present invention to overcome the above disadvantages by providing an air mover which moves air, in a novel way, hence quietly and in volume.

More specifically, it is an object of the present invention to provide an air mover for moving air, by pushing the same continuously and as quietly as a breeze enters a window. The air mover of the invention comprises a frame, a pair of "disks" or the "equivalent" eccentrically and rotatably supported in spaced apart relationship within the frame, and paddles rotated, with their planes at approximately right angles to the flow of air, to and between the pair of disks. Preferably, one of the pair of disks is driven, and the other disk is driven via shafts connecting the paddles to the disks. In an alternative, both disks are driven simultaneously from a single source. In accordance with this invention for example one "disk" is high and the other low and they support the paddles between them by shafts located between the tops of the paddles and the high "disk" and by shafts located between the tops of the paddles and the high "disk" and by shafts located between the bottoms of the paddles and the low "disk". Thus the paddles are held, when moving air, always at approximately right angles to the direction of flow of the air being moved. Preferably, the torque is transmitted to one of the pair of "disks" via V-groove in the periphery of the "disk" and is driven by a V-belt that is powered by an electric motor. This invention can be used to move air in conjunction with a thermal exchange unit of the kind including heat pumps, evaporative coolers, air conditioners, heat exchange units and solar heating.

Other objects of the present invention will in part be obvious and will in part appear hereinafter.

The invention accordingly comprises the air mover of the present disclosure, its components, parts and their interrelationships, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings, wherein.

DETAILED DESCRIPTION OF THE PREFERRED EMBODIMENT

Figure 1:
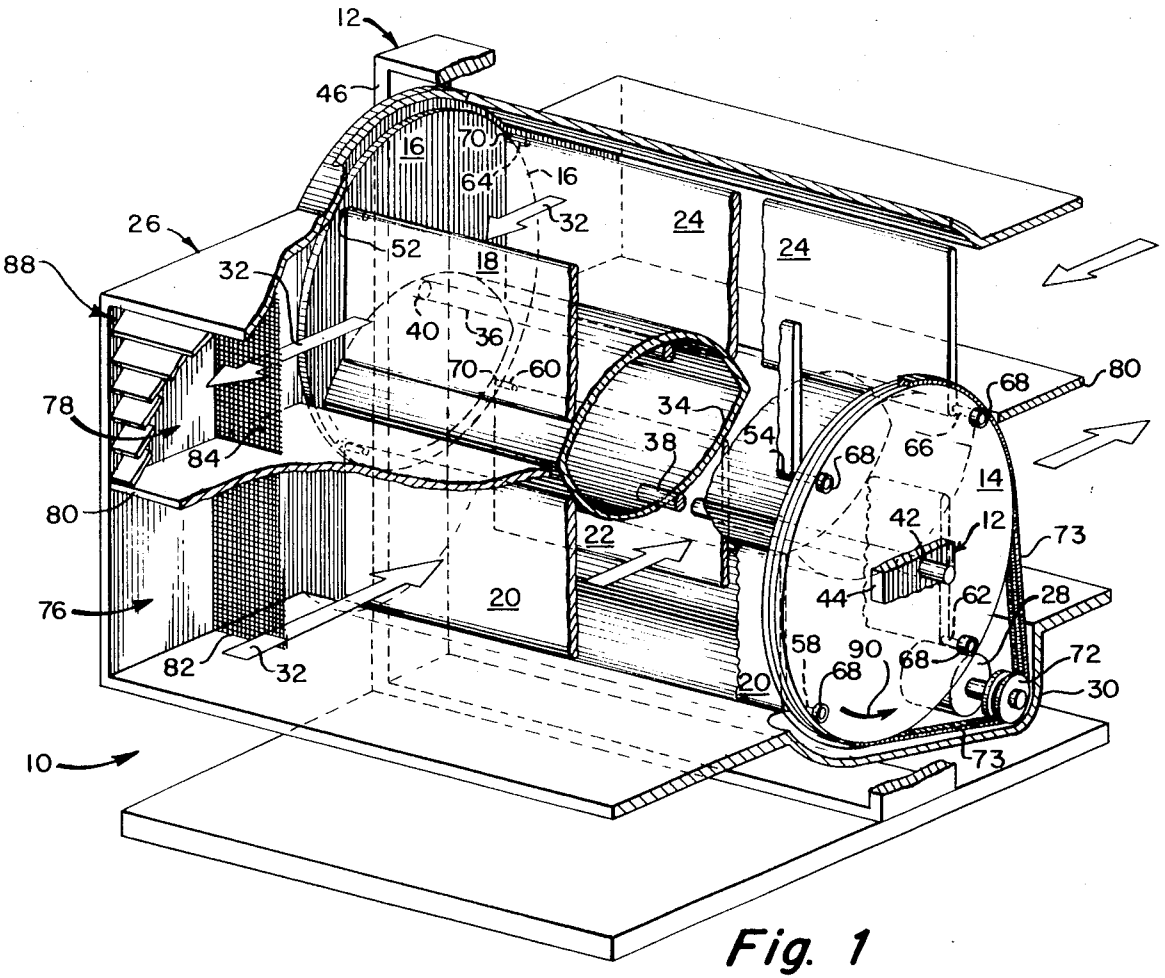
FIG. 1 is a perspective view, partly broken away, of an air mover constructed in accordance with the present invention.

Generally, the illustrated embodiment of an air mover for moving air, quietly and in volume, is depicted in perspective in FIG. 1. The air mover 10 essentially comprises a frame 12, a pair of disks 14 and 16 eccentrically and rotatably supported in spaced apart relationship within the frame 12, and a plurality of paddle members 18, 20, 22, and 24 respectively mounted to and in between the pair of disks 14 and 16. The air mover 10 is enclosed within a case 26, which preferably also includes a small electric motor 28. Preferably, the motor 28 is acoustically shielded, as at 30.

It is to be noted that the planes or surfaces, as represented by their wide sides, of the paddle members 18, 20, 22, and 24 always are positioned at right angles to the flow of air, which they create, as represented by arrows 32. It is also to be noted that these paddle members 18, 20, 22, and 24 are designed to move the air, by pushing or shoving the same quietly, continuously and effectively. It is further to be noted that the paddle members 18, 20, 22, and 24 push the same volume of air in one direction as in the opposite direction. The fluid pressure prevailing in a room employing the air mover 10 of the invention is, therefore, not affected. If desired however, the air mover 10 of the invention also can be used to move air in one direction only.

It is further to be noted that the air mover 10 has only the above-mentioned two kinds of moving operative parts to move air quickly and in volume, namely, the pair of disks 14 and 16 and the plurality of paddle members 18, 20, 22, and 24. While the air mover 10 is illustrated with four paddle members, an air mover embodying the principles of the present invention can be built having six, eight or even more paddle members.

It is further to be noted that the air mover 10 of the invention can be used by itself, or it can be employed in connection with a conventional thermal exchange unit of the kind including heat pumps, evaporative coolers and air conditioners, if desired.

Figure 2:
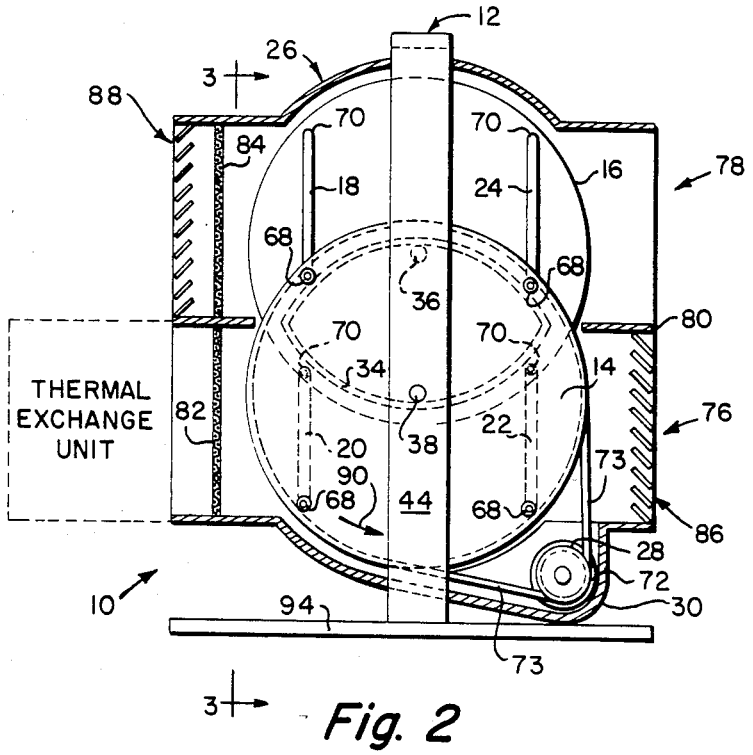
FIG. 2 is a schematic side view of the air mover of FIG. 1, shown in association with a thermal exchange unit.

As may be best observed in FIGS. 1 and 2, a baffle member 34 also preferably is mounted, albeit stationarily, between the pair of disks 14 and 16. In right cross section, the baffle member 34 defines a shape akin to that of an ellipse. The plurality of paddle members 18, 20, 22, and 24 are designed to move about the elliptical circumference of the baffle member 34, when pushing the air, in an elliptical path as defined by the baffle member's cross section, please observe FIG. 2. Such moving of the air by the paddle members 18, 20, 22, and 24 is effected first in one direction and then in the opposite direction.

The baffle member 34 is stationarily secured between the pair of disks 14 and 16 by a pair of support rods 36 and 38. Rods 36 and 38 respectively are anchored, as at 40 and 42, cantilever-style, in a pair of uprights 44 and 46. The uprights 44 and 46, of course, form a pair of the frame 12 and are respectively secured, in parallel spaced apart relation, to and within the case 26. The case 26 also preferably includes a flat stand 94 on which the unit is supported, note FIG. 2. The respective free ends 48 and 50 of the support rods 36 and 38 do not quite reach the respective edges of the baffle member 34, as may be best observed in FIG. 3.

Figure 3:
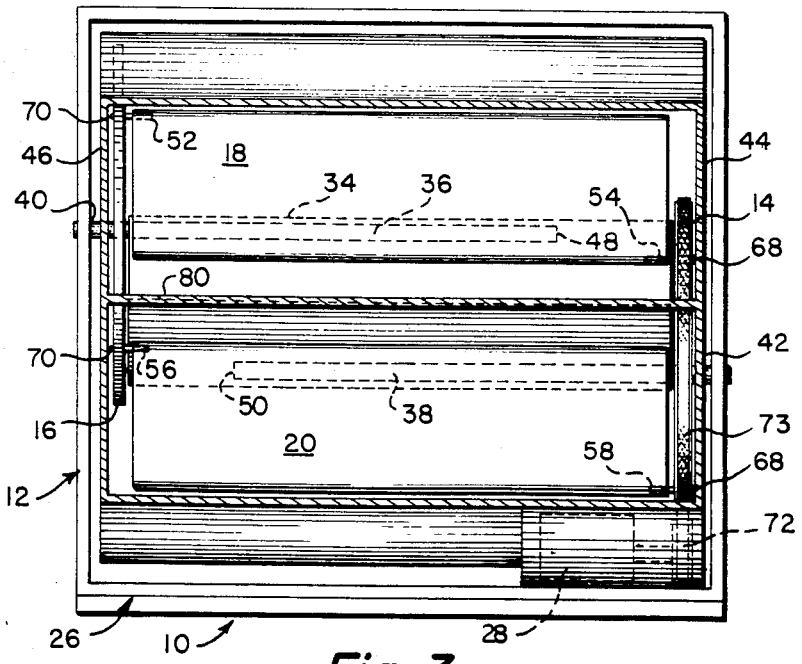
FIG. 3 is a schematic front elevational view of the air mover of FIG. 1.

It is to be noted that these support rods 36 and 38 define the centers of rotation of the respective pair of disks 14 and 16, which rotate about the rods 36 and 38 in parallel planes adjacent the pair of uprights 44 and 46 and in close proximity to the edges of the baffle member 34, observe FIG. 3.

Each of the plurality of paddle members 18, 20, 22, and 24 is rotatably secured to the pair of disks 14 and 16 by respectively pairs of pins 52, 54; 56, 58; 60, 62; and 64, 66. These pins respectively are secured in opposed corners of the paddle members and are rotatably mounted in holes 68 and 70, respectively formed in the pair of disks 14 and 16. To facilitate the rotational support of the pins 52–66 for the paddles 18–24 within the holes 68, 70, the holes preferably are lines with oiled sintered bronze bushings, not shown.

As may be observed, the motor 28 is designed to drive but one 14 of the pair of disks 14 and 16. It is the paddle members 18, 24 that transmit the rotational motion therefrom to the other 16 of the pair of disks 14 and 16. There can be several different ways for transmitting the torque from the motor 28 to the drive disk 14. The one preferred illustrated way includes the employment of a V-groove pulley wheel 72 frictionally engaging a V-belt 73, which in turn frictionally engages a V-groove periphery 74 provided on the circumference of the disk 14. Such an arrangement is entirely satisfactory with small units, i.e. about one or two cubic feet size for the air mover 10. This is particularly so since the air mover 10 of the invention, whatever its size, is designed to be rotated at a relatively low speed, in low 100's R.P.M., so as to be operating very quietly. Such low speeds are to be contrasted to the usual speed of about 1,800 rpm with which ventilating fans are normally driven.

The case 26 of the air mover 10 preferably is formed with two ducts, a lower duct 76 and an upper duct 78, separated by a partition 80. Depending on which direction the disk 14, and thus paddle members 18, 20, 22, and 24 and also the disk 16, are driven. One of the ducts 76 and 78 will serve as the air intake duct and the other as the air output duct. Preferably, the case 26 also incorporates a screen 82, 84, one for each duct 76 and 78, and at least one louver 86 and 88 for each of the ducts 76 and 78, at the respective exit ends thereof.

The air mover 10 of the invention, when intended for home use, preferably is relatively light and can be portable and used anywhere where a conventional 120 VAC outlet exists into which the electrical cord, not shown, of the motor 28 can be plugged. For example, the air mover 10 can be placed in the window of a room, not shown, such as a bedroom. With the paddle members 18, 20, 22, and 24 being driven in the direction of the arrow 90, the upper duct 78 removes warm air from the room. At the same time, the lower duct 76 draws into the room an equal amount of cooler air from outdoors. The movement of these opposed air segments is effected by the air mover 10 quietly and efficiently, i.e., without the customary noise associated with fans and air conditioners.

The air mover 10 of the invention also may be used in conjunction with a thermal exchange unit 92 of the kind including heat pumps, evaporative coolers and air conditioners, preferably central air conditioners, so that air can be moved in and out of room serviced by the central air conditioner quietly and in volume.

The air mover 10 of the invention also is useful for exhausting foul and/or smoky air from offices or conference rooms; and for moving, quietly and in volume and also in one direction only, warm, dry air from a heated room to an adjacent unheated room. The air mover 10 also is useful for ventilating marine craft, such as houseboats and moored ships and vessels.

Thus it has been shown and described an air mover 10 designed for moving air, quietly and in volume, which air mover 10 satisfies the objects and advantages set forth above.

Since certain changes may be made in the present disclosure without departing from the scope of the present invention, it is intended that all matter described in the foregoing specification or shown in the accompanying drawings, be interpreted in an illustrative and not in a limiting sense.

What is claimed is:

1. A device for moving air quietly, said device comprising:

(a) housing means having input and output ports;

(b) first rotatable means journalled in said housing means for rotation, and second rotatable means journalled in said housing means for rotation, said first rotatable means and said second rotatable means being spaced from and generally parallel to each other; and (c) a plurality of paddle means each having a pair of opposed portions, one of said pair of opposed portions being journalled on said first rotatable means, the other of said pair of opposed portions being journalled on said second rotatable means;

(d) said paddle means orbiting and being spaced from each other in mechanically balanced relation and maintaining predetermined orientation as said first rotatable means and said second rotatable means rotate;

(e) baffle means mounted in said housing means free of said orbiting of said paddle means;

(f) whereby said plurality of paddle means cause quiet movement of air through said housing means.

2. The device of claim 1, wherein each of said plurality of paddle means is substantially rectangular with said opposed portions being at corners thereof.

3. The device of claim 1 including motor means and belt means connected between said motor means and one of said first rotatable means and said second rotatable means to cause rotation of said first rotatable means and said second rotatable means quietly.

4. The device of claim 1 wherein said first rotatable means and said second rotatable means rotate in the lower hundreds of revolutions per minute.

5. A device for moving air quietly, said device comprising:

(a) housing means having entrance and exit openings;

(b) first rotatable means journaled in said housing means for rotation generally with respect to a first axis, and second rotatable means journalled in said housing means for rotation generally with respect to a second axis, said first axis and said second axis being spaced from and generally parallel to each other;

(c) a plurality of generally rectangular paddle means each having a pair of opposed portions, one of said opposed portions being journalled on said first rotatable means for orbiting generally with respect to said first axis, and the other of said opposed portions being journalled on said second rotatable means for orbiting generally with respect to said second axis, (d) said paddle means orbiting and being spaced from each other in mechanically balanced relation and maintaining predetermined orientation as said first rotatable means and said second rotatable means rotate;

(e) baffle means mounted in said housing means within and free of said orbiting of said paddle means; and (f) motive means for causing rotation of said rotatable means for orbiting of said paddle means;

(g) whereby said plurality of paddle means cause quiet movement of air through said housing means.

6. A device for quietly and gently pushing air in opposite horizontal directions, said device, when in a vertical attitude, comprising:

(a), generally rectangular housing means having open opposite ends;

(b) an upper rotor and a lower rotor being vertically mounted on opposite sides of said housing means at upper and lower vertical positions;

(c) a plurality of substantailly rectangular paddles with high and low diagonally related corner areas;

(d) a plurality of connectors for rotatably connecting said high corner areas to said upper rotor and a plurality of connectors for rotatably connecting said low corner areas to said lower rotor;

(e) said paddles orbiting in said housing means while being maintained at right angles to said horizontal direction;

(f) baffle means mounted in said housing means within and free of the orbit of said paddles; and (g) motive means for causing rotation of said rotors and orbiting of said paddles.

7. The device of claim 6 wherein said motove means includes an electrical motor and a belt operatively connected between said motor and at least one of said rotors.

8. The device of claim 7 wherein said motive means causes rotation of (the) said rotors in the lower hundreds of revolutions per minute.

9. A device for quietly and gently pushing air directionally, said device comprising:

(a) a housing means, (b) a first rotor and a second rotor mounted in parallelism at opposite sides of said housing means at offset positions;

(c) a plurality of generally rectangular paddles with first and second offset diagonally related corner areas;

(d) a plurality of connectors for rotatably connecting said first corner areas to said first rotor and a plurality of connectors for rotatably connecting said second corner areas to said second rotor;

(e) said paddles being maintained in parallelism at right angles to said given direction;

(f) baffle means mounted in said housing within and free of the orbit of said paddles; and (g) a motor for causing rotation of said rotors and orbiting of said paddles.

* * * * *